US005970936A

United States Patent [19]

Cabrera et al.

[11] Patent Number: 5,970,936

[45] Date of Patent: Oct. 26, 1999

[54] CUT-OFF OF A MOTOR VEHICLE STARTER

[75] Inventors: Jean-Jacques Cabrera, Savigny Sur Orge; Philippe Baravian, Alfortville, both of France

[73] Assignee: Valeo Electronique, Creteil, France

[21] Appl. No.: 08/937,508

[22] Filed: Sep. 25, 1997

[30] Foreign Application Priority Data

Sep. 27, 1996 [FR] France ..... 96 11793

[51] Int. Cl.[6] ..... F02N 11/08

[52] U.S. Cl. ..... 123/179.3

[58] Field of Search ..... 123/179.3, 179.4, 123/179.2; 290/38 R, 38 C

[56] References Cited

U.S. PATENT DOCUMENTS

| | | | |
|---|---|---|---|
| 4,947,051 | 8/1990 | Yamamoro et al. . | |
| 5,349,931 | 9/1994 | Gottlieb et al. | 123/179.2 |
| 5,601,058 | 2/1997 | Dyches et al. | 123/179.2 |

FOREIGN PATENT DOCUMENTS 2 626 417 7/1989 France .

OTHER PUBLICATIONS

Patent Abstracts of Japan vol. 096, No. 005, May 31, 1996 & JP 08 021343 (Chuo Spring Co Ltd) Jan. 23, 1996.

Patent Abstracts of Japan vol. 015, No. 232 (M–1124), Jun. 13, 1991 & JP 03 070868 A (Nippondenso Co Ltd), Mar. 26, 1991.

French Search Report dated Nov. 1997.

*Primary Examiner*—Tony M. Argenbright
*Assistant Examiner*—Arnold Castro
*Attorney, Agent, or Firm*—Morgan & Finnegan, L.L.P.

[57] ABSTRACT

The power supply to a starter of a motor vehicle engine is cut off when the power supply voltage to the starter reaches a threshold value. On closing of the starter power contacter, a time window is commenced, and during this time window the maximum value assumed by the supply voltage is measured. The threshold value is determined as a function of the maximum value measured during this time window, and may also be a function of the value of the supply voltage prior to initiation of the starting process, and/or a function of operating temperature.

8 Claims, 1 Drawing Sheet

CUT-OFF OF A MOTOR VEHICLE STARTER

FIELD OF THE INVENTION

The present invention relates to methods and devices for cutting off the power supply to a starter of a motor vehicle engine.

BACKGROUND OF THE INVENTION

Conventionally, the cutting off or termination of the starting phase of the engine, in which the engine is driven by its starter, is controlled by the user of the vehicle, who cuts off the supply to the starter motor by releasing the ignition key when the engine makes the appropriate characteristic sound. However, the current tendency to make internal combustion engines more and more silent results in the fact that it is becoming difficult for the driver to detect such characteristic sound, and therefore to detect that the engine has started. This leads to undue delay in releasing the ignition key, and, as a result, to the application of unnecessary and excessive forces on the starter.

Numerous devices for cutting off the power supply of a motor vehicle starter when the engine has started and is sufficiently autonomous to achieve its slow running mode by itself, are already known. In particular, it has been proposed to control cut-off of a starter by comparing the battery voltage with a reference voltage, the power supply to the starter being cut when the battery voltage reaches this reference voltage. A device which operates in this way is described in the introduction of French patent specification No. FR 2 626 417.

In this connection, it is known that when a starter begins to drive a heat engine, the voltage across the battery (the battery voltage) undergoes a sharp reduction in level due to the heavy current that flows in the starter motor. The battery voltage regains its initial level when the engine has started.

However, such a device is not fully satisfactory. In particular, the comparison with a predetermined reference value does not enable sufficient precision to be obtained in the controlled cut-off of the starter power supply. In addition, the battery voltage can undergo considerable variation over a period of time, in particular as a function of the state of battery maintenance, or as a function of ambient temperature.

DISCUSSION OF THE INVENTION

An object of the invention is to overcome at least some of these drawbacks.

According to the invention in a first aspect, a method of cutting off the power supply of a starter for a motor vehicle engine, in which the power supply voltage to the starter is measured, and the power to the starter is cut when this measured voltage reaches a predetermined threshold value, is characterised in that a time window is commenced on closing of the contacter of the starter, the maximum value assumed by the power supply voltage being measured during this time window, and in that the said threshold value is determined as a function of the maximum value measured during the time window.

Preferably, the threshold value is a linear combination of the said maximum value and the value of the power supply voltage prior to the command to energise the starter.

According to a preferred feature of the invention, the method further includes the step of commencing a second time window on closing of the starter contacter, the maximum value assumed by the power supply voltage to the starter being measured during the second time window; and, if this maximum value is not greater than a predetermined threshold, it is then considered that the engine is prevented from starting, or that the vehicle is in gear, and the power supply to the starter is cut.

Preferably, the threshold value with which the maximum value assumed by the power supply voltage in the said second time window is compared, is determined according to the maximum value assumed by the power supply voltage in the first said time window.

According to another preferred feature of the invention, a time window is commenced on closing of the starter control interrupter, and during this time window the mean value of the battery voltage is measured, and if this value is below a given threshold, it is considered that the starter contacter is at fault, and the power supply to the starter is cut.

The power supply voltage to the starter is preferably measured by means of a Zener diode.

The threshold value used for cutting off the power supply to the starter is preferably a function of the operating temperature.

According to the invention in a second aspect, a device for cutting off the power supply to a motor vehicle starter, comprising means for measuring the power supply voltage for the starter, together with a processing unit which cuts the power supply to the starter when the said voltage reaches a threshold value, is characterised in that the processing unit is adapted to perform a process according to the said first aspect of the invention.

Further features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
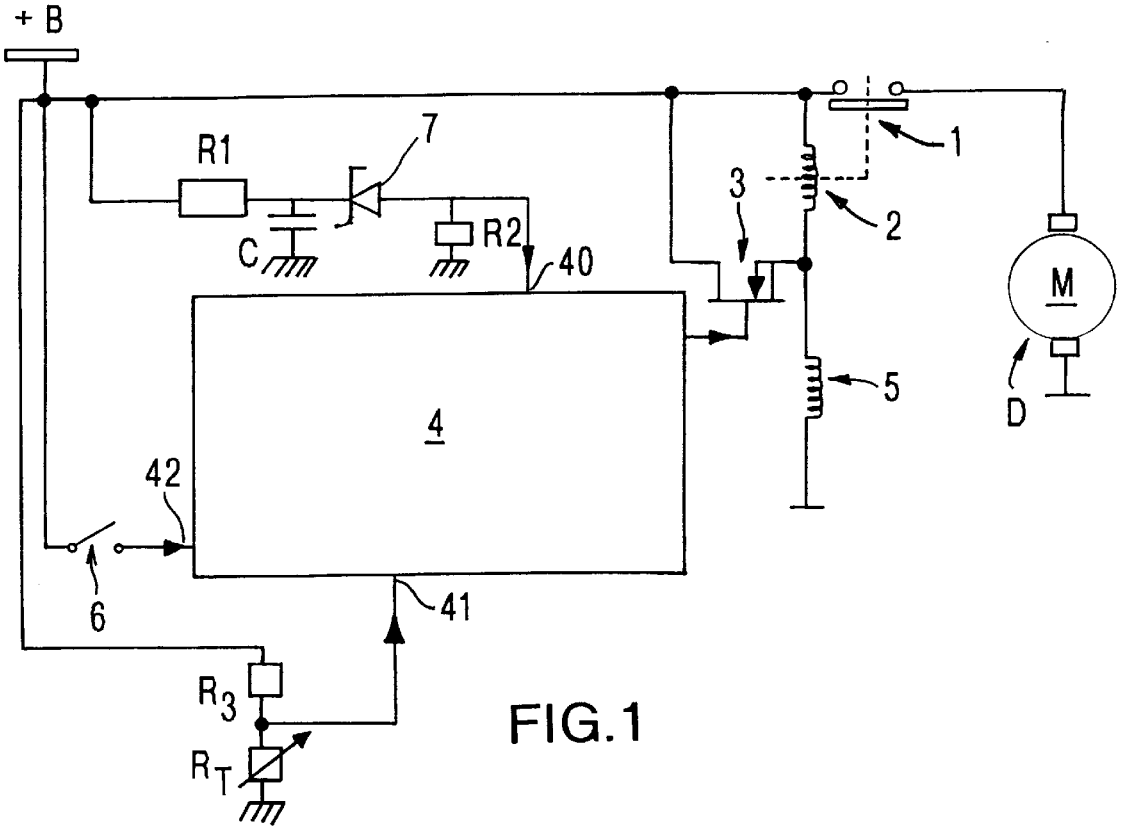
FIG. 1 is a diagram of a cut-off device for a starter in one possible embodiment of the invention.

The starter control device shown in FIG. 1 comprises an electric starter motor M which is connected between the positive terminal $B^+$ (at the battery voltage of the vehicle) and ground, and a contacter 1 is connected between the battery terminal $B^+$ and the motor M. The starter itself is generally indicated at D.

The contacter 1 is the contacter of a relay having a relay coil 2 for actuating the contacter 1. One end of the relay coil 2 is connected to the battery terminal $B^+$. Its other end is connected firstly to the source of a Mosfet transistor 3, and secondly to an inductance 5 which is connected to ground. The drain of the transistor 3 is connected to the battery terminal $B^+$, and its grid is connected to the output of a processing unit 4 which supplies a control voltage to the transistor 3.

The processing unit 4 is for example in the form of a microprocessor. It generates the control voltage as a function of the battery voltage at the terminal $B^+$, and also as a function of the position of a starter interrupter 6, which is for example the ignition switch of the vehicle, operated by the ignition key. The interrupter 6 is connected between the battery terminal $B^+$ and an input 42 of the processing unit 4. Another input 40 of the processing unit 4 is connected to the battery terminal $B^+$ through a Zener diode 7, which is connected so as to be in the passing state in the direction from the input 40 towards the battery terminal $B^+$.

A filter of the R-C type is preferably connected between the Zener diode 7 and the battery terminal $B^+$, for filtering the battery voltage so as to remove parasitic variation from it. In FIG. 1, this filter consists of a resistor $R_1$ connected between the diode 7 and the battery terminal $B^+$, together with a capacitor C which is connected between the common point of the resistor $R_1$ and the diode 7, and ground.

The anode of the Zener diode 7 is also connected to ground through a further resistor $R_2$, the voltage measured at the input 40 of the processing unit 4 being the voltage across this resistor $R_2$.

The battery terminal $B^+$ is also connected to a third input 41 of the processing unit 4, through a voltage splitting bridge which comprises a resistor $R_3$ and a variable resistance $R_T$, the latter being variable as a function of temperature. This voltage splitting bridge accordingly supplies a signal to the processing unit 4, via its input 41, representing the prevailing operating temperature of the starter.

Figure 2:
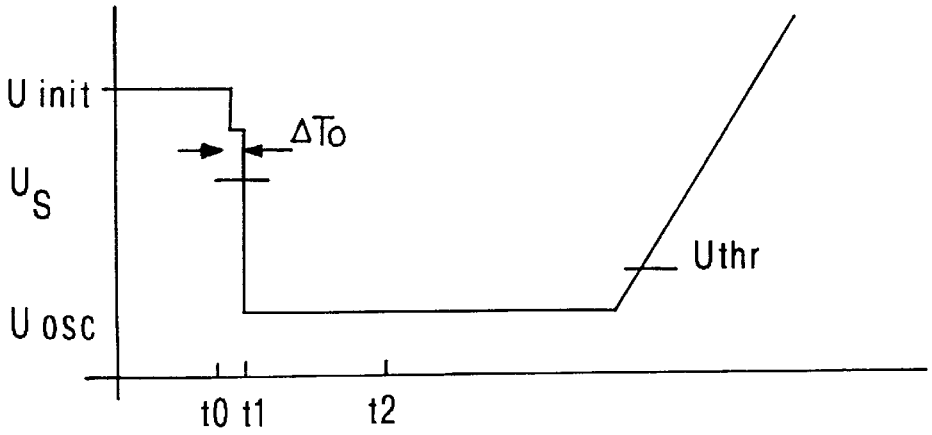
FIG. 2 is a graph in which battery voltage is plotted against time, and shows the form of the curve of battery voltage during a starting operation.

Referring now to FIG. 2, the battery voltage which prevails before the interruptor 6 is closed is denoted as Uinit. When, at an instant t0, the driver operates the ignition key to close the starter interrupter 6, the processing unit 4 produces an output signal through the transistor 3 (the latter operating as an interrupter) to operate the relay so as to close its power contacter 1.

The power contacter 1 has a double function. Firstly, it constitutes a linear actuator which displaces the starter pinion (not shown) of the starter D. Secondly, the contacter 1 supplies the starter motor M with power. When the contacter 1 is closed, the phase commences in which the starter pinion is being displaced towards its position meshing with the starter ring on the flywheel of the engine (not shown); and the battery voltage falls to a first reduced level $U_1$.

Then, as the contacter 1 becomes fully closed, at an instant t1, current flows in the starter motor M and the battery voltage falls once again. This voltage remains at a low level so long as the engine of the vehicle has not yet started. During this period, from the instant t, the battery voltage fluctuates, its fluctuations corresponding to the compression cycles of the engine. These fluctuations are not shown in FIG. 2, which simply indicates the maximum value Uosc of the fluctuating battery voltage. Once the engine has started, these fluctuations disappear, and the battery voltage rises once again so as to regain its initial value Uinit.

When the starter power contacter 1 closes at the instant t1, the processing unit 4 begins a time window from the instant t1 to an instant t2. During this time window, the unit 4 measures the maximum value Uosc of the fluctuations in the battery voltage. The duration of this time window is for example of the order of 2 or 3 seconds. The value Uosc is used, together with the initial value Uinit of the battery voltage, for determining a threshold value of the voltage Uthr. When the actual battery voltage reaches the threshold value Uthr, this causes the starter D to be cut off. This battery voltage Uthr may for example be a linear combination of the initial voltage Uinit and the voltage Uosc.

It will be noted that the initial battery voltage Uinit is of the order of 10 to 14 volts, while the voltage drop (Uinit−Uosc) is of the order of 4 to 5 volts.

Now, the voltages which conventional microprocessors are capable of measuring are generally in the range between 0 and 5 volts. The Zener diode 7 enables the battery voltage to be put at a value which is measurable at the input of the processing unit 4. The Zener voltage of this diode is for example in the range 7 to 10 volts.

In this connection, the threshold value Uthr of the battery voltage is preferably determined by a law expressed as follows:

$$Uthr=Uinit-(Uinit-Uosc)\times R,$$

where R is a coefficient the value of which is in the range between 0 and 1, and is determined according to the operating temperature. The processing unit 4 is connected, as mentioned above, through its input 41, to the resistors $R_3$ and $R_T$ which together constitute a temperature sensor. The variable resistance $R_T$ is for example of the "CTN" type.

Apart from this facility for the processing unit 4 to respond to the operating temperature of the starter D, other functions can also be provided. In particular, it can be arranged that if the battery voltage does not change significantly between the instant t1at which the contacter 1 is closed, and an instant t3, at the end of which time it would be expected that the engine has started, then the microprocessor 4 can be arranged to treat the engine as being prevented from starting, or that the vehicle is in gear. In that event it cuts off the power supply to the starter.

In the same way, if in a time window following the instant t0 at which the driver operates the starter interrupter 6, for example by turning the ignition key, the mean value of the battery voltage descends below a given threshold $U_s$, and the power supply to the motor is cut. In this connection, it is considered in this case that the starter contacter 1 is at fault, for example that it is in its closed position whereas it ought to be open, and that it is therefore appropriate to cut the power supply to the motor, so as to protect its electronic control or processing unit 4 and the interrupter comprising the transistor 3 that controls the supply of power to the motor.

FIG. 2 indicates the above mentioned time window at ΔT0, and its duration is for example of the order of 20 milliseconds.

An image of the mean value of the battery voltage is determined by obtaining the arithmetic mean of n samples (where for example n=4) of the voltage at the input 40 of the processing unit 4, these samples being taken during the time window.

What is claimed is:

1. A method of controlling the cutting off of power supplied to a motor vehicle starter, in a motor vehicle having an engine and including the starter for starting the engine, a power source selectively supplying power to the starter, and a control device coupled to the power source and the starter, the control device including a starter contacter connected between the power source and the starter, the method comprising the steps of:

closing the starter contacter to supply power from the power source to the starter, thereby energizing the starter;

during a first time window while energizing the starter after closing the starter contacter, measuring a maximum value assumed by the output voltage of the power source;

determining a first threshold value as a function of said maximum value measured during said first time window; and opening the closed said starter contacter to cut off the power to the starter when the output voltage of the power source increases to said first threshold value.

2. A method according to claim 1, further including the step of measuring an initial value of the output voltage of the power source prior to energizing the starter, the step of determining the threshold value comprising determining the threshold value as a linear combination of the maximum value and the initial value.

3. A method according to claim 1, further including the steps of: commencing a second time window on closing of the starter contacter; measuring, during the second time window, the maximum value assumed by the output voltage of the power source; determining a second threshold value of the output voltage of the power source, the step of cutting off power to the starter being effected at the end of the second time window if the maximum value during the second time window fails at that time to exceed a second threshold value.

4. A method according to claim 3, wherein the step of determining the second threshold value comprises determining the second threshold value as a function of the maximum value of the supply voltage in the first time window.

5. A method according to claim 1, wherein the vehicle further includes a starter control interrupter connected between the power source and the control device, the method further including commencing a second time window on closing of the starter control interruptor, measuring the output voltage of the power source during said second time window, and determining a given second threshold value, the said step of cutting off power to the starter being performed at the end of the second time window if the output voltage of the power source is below said second threshold value.

6. A method according to claim 1, wherein the supply voltage is measured by means of a Zener diode.

7. A method according to claim 1, further including the step of measuring the operating temperature of the starter, the step of determining the first threshold value comprising determining the first threshold value as a function of said operating temperature.

8. A device for cutting off the power supply to a motor vehicle starter, comprising a starter contacter, means for measuring the power supply voltage for the starter, and a processing unit coupled to the starter contacter and to the measuring means, the processing unit operative in executing the method according to claim 1.

* * * * *